US008966872B2

(12) United States Patent
Cheng et al.

(10) Patent No.: US 8,966,872 B2
(45) Date of Patent: Mar. 3, 2015

(54) MULTI-STRAND STEEL CORD WITH WAVED CORE STRAND

(75) Inventors: Zhichao Cheng, Jiangsu (CN); Pengfei Wang, Jiangsu (CN); Jiankao Chen, Jiangsu (CN)

(73) Assignee: NV Bekaert SA, Zwevegem (BE)

( * ) Notice: Subject to any disclaimer, the term of this patent is extended or adjusted under 35 U.S.C. 154(b) by 0 days.

(21) Appl. No.: 13/991,969

(22) PCT Filed: Nov. 15, 2011

(86) PCT No.: PCT/EP2011/070096

§ 371 (c)(1),
(2), (4) Date: Jun. 6, 2013

(87) PCT Pub. No.: WO2012/076297

PCT Pub. Date: Jun. 14, 2012

(65) Prior Publication Data

US 2013/0261223 A1 Oct. 3, 2013

Related U.S. Application Data

(63) Continuation of application No. PCT/CN2010/002012, filed on Dec. 10, 2010.

(51) Int. Cl.
*D07B 1/06* (2006.01)
*D07B 7/02* (2006.01)

(52) U.S. Cl.
CPC ..... *D07B 1/0613* (2013.01); *D07B 7/025* (2013.01); *D07B 2201/2021* (2013.01); *D07B 2201/2059* (2013.01); *D07B 2201/2061* (2013.01); *D07B 2501/2046* (2013.01); *D07B 2501/2076* (2013.01)
USPC ..... 57/311

(58) Field of Classification Search
USPC ..... 57/212, 218, 231, 236, 237, 311
See application file for complete search history.

(56) References Cited

U.S. PATENT DOCUMENTS 3,413,792 A * 12/1968 Werdenberg ..... 57/9
4,258,543 A * 3/1981 Canevari et al. ..... 57/212

(Continued)

FOREIGN PATENT DOCUMENTS

EP 0 841 430 A1 5/1998
JP 10131066 A 5/1998

(Continued)

OTHER PUBLICATIONS

Polygonally Preformed Steel Elements, Research Disclosure, Jul. 1, 1994, pp. 359-365, Mason Publications, Hampshire, GB.

(Continued)

*Primary Examiner* — Shaun R Hurley
(74) *Attorney, Agent, or Firm* — Foley & Lardner LLP

(57) ABSTRACT

A steel cord (10) adapted for the reinforcement of elastomeric products comprises a core strand (12) and a layer of outer strands (14) arranged around the core strand (12). The core strand (12) comprises a core and at least a layer arranged around the core. The core further comprises one to three core filaments and the layer further comprises three to nine layer filaments. The core strand (12) has a first wave form and each filament of the outer strands (14) has a second wave form such that the first wave form is substantially different from the second wave form. This allows to guarantee full rubber penetration.

14 Claims, 2 Drawing Sheets

(56) References Cited

U.S. PATENT DOCUMENTS

Figure 1:
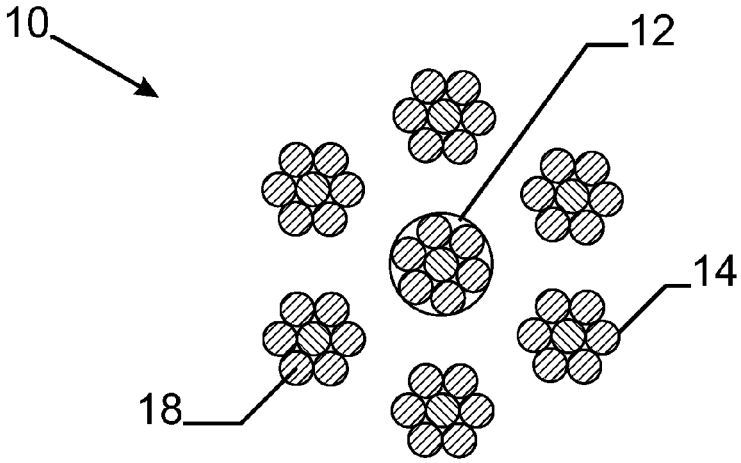

| | | | | |
|---|---|---|---|---|
| 5,319,915 | A * | 6/1994 | Kobayashi et al. | 57/200 |
| 5,461,850 | A * | 10/1995 | Bruyneel et al. | 57/212 |
| 5,581,990 | A * | 12/1996 | Van Giel et al. | 57/311 |
| 5,595,057 | A | 1/1997 | Kuriya | |
| 5,606,852 | A * | 3/1997 | Yanagisawa | 57/207 |
| 5,707,467 | A * | 1/1998 | Matsumaru et al. | 152/527 |
| 5,878,564 | A | 3/1999 | De Vos | |
| 5,968,651 | A * | 10/1999 | De Vos et al. | 428/377 |
| 6,415,593 | B1 * | 7/2002 | Miyazaki et al. | 57/236 |
| 6,678,921 | B2 * | 1/2004 | Despault et al. | 24/16 PB |
| 6,904,744 | B2 * | 6/2005 | Cauwels et al. | 57/219 |
| 7,131,257 | B2 * | 11/2006 | Miyazaki et al. | 57/236 |
| 8,001,758 | B2 * | 8/2011 | Morioka | 57/236 |
| 8,359,823 | B2 * | 1/2013 | Qi | 57/212 |

FOREIGN PATENT DOCUMENTS

| | | | |
|---|---|---|---|
| JP | 2009-133017 | A | 6/2009 |
| WO | WO 95/16816 | A1 | 6/1995 |
| WO | WO 2010/060878 | A1 | 6/2010 |
| WO | WO 2010/112304 | A1 | 10/2010 |

OTHER PUBLICATIONS

Anonymous, Micro-Alloyed Steel Cord Constructions for Tyres, Research Disclosure, May 1, 1993, 26 pages, vol. 349, No. 84, Mason Publications, Hampshire, GB.

* cited by examiner

MULTI-STRAND STEEL CORD WITH WAVED CORE STRAND

TECHNICAL FIELD

The present invention relates to a steel cord adapted for the reinforcement of elastomeric products such as rubber tyres, rubber track, conveyor belts, . . . .

BACKGROUND ART

JP 10 131066 A discloses a conventional 7×7 multi-strand steel cord adapted to reinforce heavy duty tyres. In this 7×7 multi-strand steel cord, each strand consists of one core filament and six sheath filaments. This 7×7 multi-strand steel cord construction suffered in some cases from an insufficient degree of rubber penetration. As a result, each strand, and especially the core strand, suffered from core migration, bad fatigue behavior and was subject to corrosion just because there was almost no rubber penetration between the six sheath filaments and the core filament.

Since a few decades the art of steel cords has known a continuous trend towards trying to achieve full rubber penetration between the individual steel filaments of the steel cords, attempts have been made to allow rubber to fully penetrate. EP 0 841430 A discloses a steel cord comprising one core filament with a first wave form and six layer filaments with a second wave form arranged around the core filament wherein the first wave form substantially different from the second wave form. The object of this wavy form is to create micro-gaps between the layer filaments and the core filament to allow rubber to penetrate. Such a layer steel cord with a sufficient rubber penetration can be manufactured using only one twisting step. But in order to achieve full rubber penetration in a multi-strand steel cord, it is not enough only to create micro-gaps between the layer filaments and the core filament(s) in each strand; the micro-gap between the core strand and the adjacent outer strand is also very important.

DISCLOSURE OF INVENTION

The invention aims at avoiding the disadvantages of the prior art.

It is an object of the present invention to provide for a multi-strand steel cord with a sufficient rubber penetration.

It is also an object of the present invention to provide for a multi-strand steel cord without core migration problem.

It is another object of the present invention to provide for a steel cord which has a good fatigue behaviour.

According to the invention, there is provided a steel cord which comprises a core strand and a layer of outer strands arranged around said core strand. The core strand comprises a core and at least a layer arranged around the core. The core further comprises one to three core filaments, and the layer comprises three to nine layer filaments. Each of the outer strands comprises outer strand filaments lying at the radially external side of the outer strands. The core strand has a first wave form, and each of the outer strand filaments has a second wave form, the first wave form is substantially different from the second wave form.

The terms "a first wave form substantially different from the second wave form" mean that the first wave form has an amplitude, a phase, a wave pitch, a series of harmonics (obtained by means of a mathematical Fourier analysis on a projection of the wave form) or any combination of amplitude, phase, wave pitch or series of harmonics that is substantially different from the amplitude, phase, wave pitch, series of harmonics or corresponding combination thereof of the second wave form.

The core strand may have a planar wave form, i.e. a wave form which lies substantially in one plane, or a spatial wave form.

Preferably the filaments in the outer strands have a spatial wave form.

More preferably, the filaments in the outer strands have been polygonally preformed such that a polygonal form as disclosed in WO 95/16816 is obtained.

WO 95/16816 discloses the polygonally preformed steel filament. Polygonal performing is a preformation which gives the steel filament projections on a plane perpendicular to the longitudinal central axis. The projections are in the form of curves which are convex curves with a radius of curvature alternating between a maximum and a minimum. The radius of the curvature of the preformed steel filament alternates between two extremes: a minimum at the point where the highest bending has been given and a maximum at the point where the smallest bending has been given.

In a preferable embodiment of the steel cord according to the invention, the number of the outer strands is equal to six. The core strand consists of one core filament and a layer of six filaments arranged around said core filament. The core filament diameter is substantially equal to the diameter of the layer filaments. The core strand itself has a so-called crimp form obtained by means of one pair of or two pairs of toothed wheels. All the filaments of the outer strands have been polygonally preformed.

Indeed the inventors have discovered that the crimp form of the core strand is a suitable form for promoting rubber penetration not only between the individual steel filaments of the core strand itself but also between the core strand and adjacent outer strands. The combination of the crimped core strand and the polygonally performed filaments of the outer strands allows the production of a cord which has a full rubber penetration. Besides, the amplitude of the crimp form of the core strand can be reduced while maintaining the same degree of rubber penetration with the polygonally preformed filaments in the outer strands.

A preferable embodiment of the steel cord according to the invention meets one or two of the following requirements:

- the first wave form of the core strand has a first amplitude which ranges from 0.2 to 1.8 times the diameter of the core strand;
- the first wave form of the core strand has a first wave pitch which ranges from 1.1 to 4.5 times the diameter of the core strand.

If the amplitude of the first wave form of the core strand is smaller than 0.2 times the diameter of the core strand, the spacing between the core strand and the outer strands is too small to allow rubber penetration. If the amplitude of the first wave form is greater than 1.8 times of the diameter of the core strand itself, as the wave camber increases, it will result in core migration problem.

If the pitch of the first wave form of the core strand is smaller than 1.1 times the diameter of the core strand, as the wave camber increases, it with result in core migration problem. If the pitch of the first wave form is greater than 4.5 times of the diameter of the core strand itself, the spacing between the core strand and the outer strands is too small to allow rubber penetration.

A steel cord according to the invention may be used as a reinforcement for rubber track.

BRIEF DESCRIPTION OF FIGURES IN THE DRAWINGS

Figure 2:
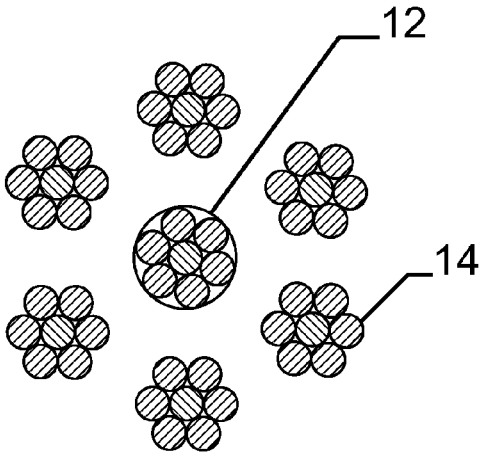
Figure 3:
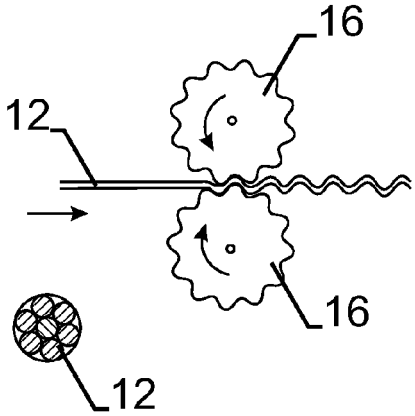
Figure 4:
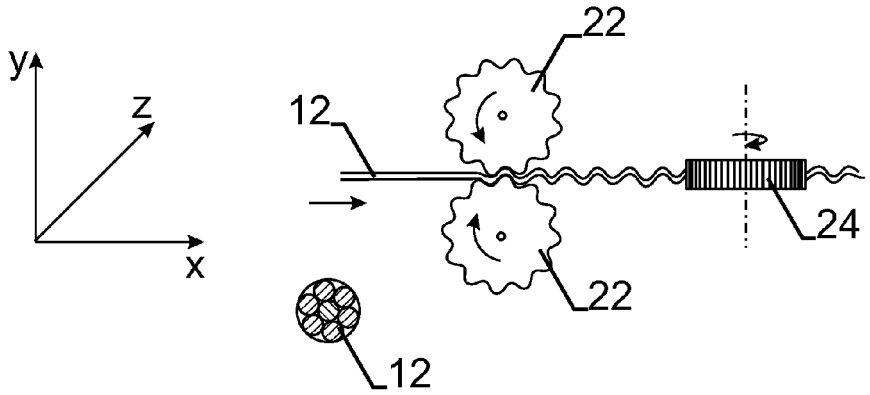
Figure 5A:
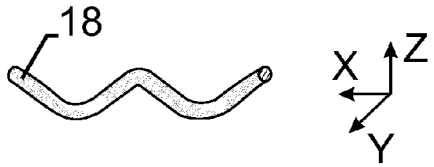
Figure 5B:
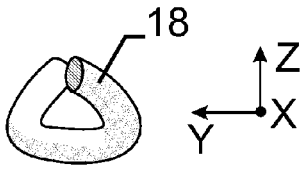
Figure 6:
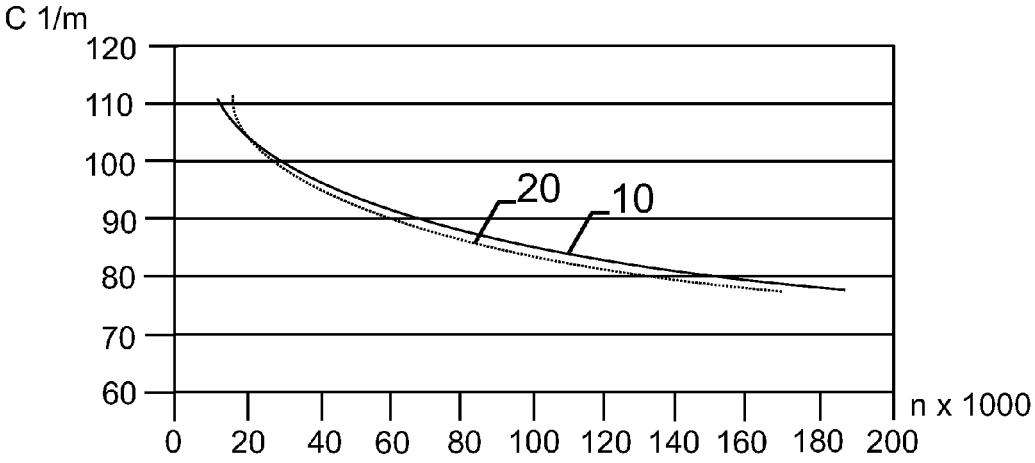

The invention will now be described in more detail with reference to the accompanying drawings:

FIG. 1 schematically shows a cross-section view of a first embodiment of a steel cord according to the present invention;

FIG. 2 schematically shows a cross-section view of a second embodiment of a steel cord according to the present invention;

FIG. 3 schematically illustrates the method to make the core strand of the steel cord wavy which lies substantially in one plane;

FIG. 4 schematically shows the method to make the core strand of the steel cord wavy in a spatial form;

FIGS. 5*a* and 5*b* schematically show respectively a longitudinal view and a frontal view of one filament in the outer strands according to the present invention;

FIG. 6 illustrates the fatigue behaviour of the steel cord in a first embodiment according to the present invention compared with the reference cord.

MODE(S) FOR CARRYING OUT THE INVENTION

FIG. 1 shows the transversal cross-section of the first embodiment of a steel cord 10—7×7 SSZ according to the invention.

A core strand 12 comprises one core filament with a diameter of 0.25 mm and a layer of six filaments arranged around the core filament with the same diameter of 0.25 mm in S direction with twisting pitch 12.5 mm;

The core strand 12 further is surrounded by six outer strands 14 in Z direction with twisting pitch 20 mm. Each outer strand 14 comprises one core filament and a layer of six filaments with the same diameter of 0.25 mm. All the filaments of the outer strand 14 have polygonal wave form.

The core strand 12 has a crimp wave form lying substantially in one plane in the first embodiment. The difference between the first embodiment of FIG. 1 and the second embodiment of FIG. 2 is that the core strand 12 of the second embodiment has a spatial wave form instead of a substantially planar wave form.

A possible explanation ft the high degree of rubber penetrability of the steel cords according to the present invention is as follows. Applying the same wave form (i.e. same phase, same amplitude, same wave pitch and same harmonies) to both core strand and the filaments of the outer strands. e.g. the core strand has a polygonal wave form the same as the filaments of the outer strands, as the core strand consists of several filaments, it is not so easy to have the whole core strand polygonal preformed; even if it might succeed, the radius of the curvature can not be great enough to meet the needs of the high degree of rubber penetrability of the core strand. If the filaments of the outer strands have the same wave form as the core strand this results in a high degree of rubber penetration if the cord is not subjected to external threes. As soon as external forces such as a bending or a pulling three are acting upon the cord, the core strand and the filaments in the outer strand wave form "fit" into one another thereby closing the created micro-gaps between the core strand and adjacent outer strands and making complete rubber penetration impossible.

The core strand 12 in the first embodiment is guided through a pair of toothed wheels 16 which give a crimp form to the core strand as shown in FIG. 3. Besides, the toothed wheels 16 are not driven by external means, but driven and rotated by the passing core strand 12.

In the second embodiment, the core strand 12 moves downstream towards a first pair of toothed wheels 22, which may be subjected to a rotation n, around an axis which coincides substantially with the path of core strand 12, and the first crimp is a planar crimp lying in an x-y plane. The thus crimped core strand 12 is further moved to a second pair of toothed wheels 24, which may be subjected to a rotation $n_d$ around an axis vertical to the path of core strand 12, and the second crimp given by toothed wheels 24 is also a planar crimp lying in an x-z plane. Therefore, the final wave given to the core strand 12 in no longer planar but spatial.

Neither the first pair of toothed wheels 22 nor the second pair of toothed wheels 24 needs to be driven by external means. They are both driven and rotated by the passing core strand 12.

The filaments 18 of outer strands 14 are guided to a preformer. Preformer is not externally driven but rotates under influence of the passing filaments 18. Preformer gives to the filaments 18 a radius of curvature that alternates between a maximum and a minimum. The action of preformer together with the action of the downstream double-twister results in a polygonal form of filament 18 of the outer strands 14 as shown in FIG. 5*a* and FIG. 5*b*.

The crimped core strand 12 and the outer strands 14, each of which consists of the polygonally preformed filaments 18 are brought together at assembly point and are guided to a double twister.

The steel cord 10 with one core strand and six outer strands according to the invention was built as follows. Starting product is a steel wire rod. This steel wire rod has following steel composition: A minimum carbon content of 0.65%, a manganese content ranging from 0.40% to 0.70%, a silicon content ranging from 0.15% to 0.30%, a maximum sulphur content of 0.03%, a maximum phosphorus content of 0.30%, all percentages being percentages by weight. A typical steel tire cord composition for high-tensile steel cord has a minimum carbon content of around 0.80 weight %, e.g. 0.78-0.82 weight %.

The steel rod is drawn in a number of consecutive steps until the required final diameter. In this example, the round diameter for the filaments both of the core strand and outer strands are 0.25 mm. The drawing steps may be interrupted by one or more heat treatment steps such as patenting.

The steel filaments are preferably provided with a coating which promotes the adhesion to rubber or with a coating which gives corrosion resistance to the wire. A rubber adherable coating is e.g. brass; a corrosion resistant coating is e.g. zinc.

After the coating, the filaments are end drawn to their final diameter and are subjected to a twisting operation as described above.

Some further details of the steel cord 10: the diameter was 2.26 mm with a fairly high difference between maximum and minimum diameter of 0.01 mm, the mass per meter was 19.52 gram/m and a breaking strength 6859 N with an elongation of 2.72% is found.

A steel cord according to the invention has been compared with other steel cord construction with respect to rubber penetration and fatigue behaviour.

The table on the following page summarizes the results of rubber penetration.

| cord construction | Top-bottom amplitude of the wave form of the core strand (mm) | APR for core strand (in %) | Air drop (in %) |
|---|---|---|---|
| Reference cord 20: 7 × 7 × 0.25 HT normal | 2.26 (no wave) | 10 | 100 |
| Reference cord 30: 0.25 + 6 × 0.25 + 6 × (0.25 + 6 × 0.25) BETRU ® | 2.26 (no wave) | 25 | 73 |
| Invention cord 10: 7 × 7 × 0.25 HT open | 3.36 | 90 | 0 |

BETRU ® is a registered trademark of N.V.BEKAERT S.A. and refers to steel cords having one or more polygonally preformed filaments according to WO 95/16816. The abbreviation "APR" means the "appearance" of the steel filament with the rubber penetration. The abbreviation "HT" means high tensile strength.

In the above table, the rubber penetration has been measured in two different ways. A first way determines the so-called "APR" and is measured here on the core strand in the following way. The multi-strand cord is embedded in rubber under conditions comparable to manufacturing conditions, thereafter the individual steel filaments are unravelled and the "APR" is the length of the a particular steel filament covered with rubber compared with the total length of that particular steel filament in the core strand. A second way is the convenient and well known air permeability method (air drop test).

As may be derived from the above table, the invention cord 10 allows to improve rubber penetration significantly, especially for the core strand. With a high ratio of "APR", the core migration problem can easily be avoided.

Besides, the steel cord 10 according to present invention has improvement on fatigue behaviour. FIG. 6 illustrates the improvements of fatigue behaviour of steel cord 10 according to the present invention. Compared with the reference cord 20, the fatigue behaviour of the steel cord 10 according to present invention is much better.

The invention claimed is:

1. A steel cord adapted for the reinforcement of elastomeric products, said steel cord comprising a core strand and a layer of outer strands arranged around said core strand, said core strand comprising a core and at least a layer arranged around said core, said core comprising one to three core filaments, said layer comprising three to nine layer filaments, each of said outer strands comprising outer strand filaments lying at the radially external side of said outer strands, said core strand having a first wave form, each of said outer strand filaments having a second wave form, said first wave form being form substantially different from said second wave form, and said first wave form is a crimp form.

2. A steel cord according to claim 1 wherein said first wave form has a first amplitude and said second wave form has a second amplitude, said first amplitude being substantially different from said second amplitude.

3. A steel cord according to claim 1 wherein said first wave form has a first wave pitch and said second wave form has a second wave pitch, said first wave pitch being substantially different from said second wave pitch.

4. A steel cord according to claim 1 wherein said second wave form is spatial.

5. A steel cord according to claim 1 wherein said first wave form is substantially planar.

6. A steel cord according to claim 1 wherein said first wave form is substantially spatial.

7. A steel cord according to claim 1 wherein said second wave form is a polygonal form.

8. A steel cord according to claim 1 wherein the core strand consists of one core filament and a layer of six filaments arranged around said core filament.

9. A steel cord according to claim 8 wherein the diameter of said core filament is equal to the diameter of said layer filaments.

10. A steel cord according to claim 1 wherein the number of said outer strands is equal to six.

11. A steel cord according to claim 1 wherein the diameter of the core strand filaments is equal to the diameter of all the outer strands filaments.

12. A steel cord according to claim 1 wherein the first amplitude ranges from 0.2 to 1.8 times the diameter of the core strand.

13. A steel cord according to claim 1 wherein the first wave pitch ranges from 1.1 to 4.5 times the diameter of the core strand.

14. Use of a steel cord according to claim 1 as reinforcement for rubber track.

* * * * *